US007180059B2

(12) United States Patent
Fischer et al.

(10) Patent No.: US 7,180,059 B2
(45) Date of Patent: Feb. 20, 2007

(54) APPARATUS AND METHOD FOR SENSOR CONTROL AND FEEDBACK

(75) Inventors: Steven M. Fischer, Hayward, CA (US); Darrell L. Gourley, San Francisco, CA (US); Glen F. Ingle, Sunnyvale, CA (US); Timothy Herbert Joyce, Mountain View, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 11/471,954

(22) Filed: Jun. 21, 2006

(65) Prior Publication Data

US 2006/0243917 A1 Nov. 2, 2006

Related U.S. Application Data

(63) Continuation of application No. 11/067,136, filed on Feb. 25, 2005, now Pat. No. 7,091,483, which is a continuation-in-part of application No. 10/640,176, filed on Aug. 13, 2003, now Pat. No. 7,078,681, which is a continuation-in-part of application No. 10/245,987, filed on Sep. 18, 2002, now Pat. No. 6,646,257.

(51) Int. Cl.
*H01J 49/10* (2006.01)

(52) U.S. Cl. ..... 250/288; 250/423 R

(58) Field of Classification Search ..... 250/288, 250/423 R

See application file for complete search history.

(56) References Cited

U.S. PATENT DOCUMENTS 7,091,483 B2 * 8/2006 Fischer et al. ..... 250/288

* cited by examiner

*Primary Examiner*—Kiet T. Nguyen

(57) ABSTRACT

The present invention relates to an apparatus and method for use with a mass spectrometry system. The invention provides an ion source, infrared emitter and sensor with closed control feedback loop coupled to the infrared emitter. Methods of control and heating using the apparatus of the present invention are also disclosed.

11 Claims, 7 Drawing Sheets

MULTIMODE ESI/APCI SOURCE

MULTIMODE ESI/APPI SOURCE

ESI SOURCE

APCI SOURCE

APPI SOURCE

APPARATUS AND METHOD FOR SENSOR CONTROL AND FEEDBACK

CROSS-REFERENCE TO RELATED APPLICATIONS

The present application is a continuation of co-pending U.S. patent application Ser. No. 11/067,136, filed on Feb. 25, 2005. The patent application. U.S. patent application Ser. No. 11/067,136 is in turn a continuation-in-part application of U.S. patent application Ser. No. 10/640,176 filed Aug. 13, 2003 that is a continuation-in-part of U.S. patent application Ser. No. 10,245,987 filed Sep. 18, 2002 (now issued as U.S. Pat. No. 6,646,257).

BACKGROUND

The advent of atmospheric pressure ionization (API) has resulted in an explosion in the use of LC/MS analysis. Various ion sources may be employed at API. For instance, there are currently four API techniques—electrospray ionization (ESI), atmospheric pressure chemical ionization (APCI), atmospheric pressure photon ionization (APPI) and atmospheric pressure matrix assisted laser desorption ionization (AP-MALDI). There is also a new concept of simultaneous ESI with APCI or APPI (multimode ionization). Each of these techniques share the common need for drying aerosol generated from the flowing liquid.

A number of approaches have been employed for drying aerosols. The two major approaches for drying aerosols have been the application of hot gas through convection or by hot surfaces by conduction.

Hot gas is the preferred approach for drying ESI aerosols, but at high liquid flow rates the amount of energy that can be delivered is very limited by the thermal capacity of the gas. The result is either a large volume of gas must be used or the gas must be heated to very high temperatures. Neither of these choices is particularly desirable since the gas used is expensive, high purity nitrogen. The other choice of heating the gas to very high temperatures seriously affects the materials that can be used in the source. Hot gas is not used for APPI or APCI sources because hot tubes are easy to install are more economical and analyte contact with the tube is permitted. Hot gas has been employed with AP-MALDI applications, but the methods are fairly crude and there is no real control of the gas to the ion source. In certain instances, the chambers are flooded with the heated gas to improve the overall instrument sensitivity. Ideally it would be desirable to be able to control the heating to improve overall ion cooling and ionization without ion clustering problems.

In addition, hot surfaces have also been employed for APPI, AP-MALDI, and APCI ion sources. In certain ion sources there are advantages of not having the aerosol come in contact with a surface. Many materials can be catalytic to chemical reactions. Avoiding surface contact can avoid or eliminate many of these problems. In addition there are subtle ionization mechanisms possible from gas shearing that are usable if the aerosol does not come into contact with a surface. For these reasons, there is a need for improvements over the presently existing devices and designs.

The practical problem with most of these techniques is temperature control. Many analytes are thermally sensitive and will not tolerate high temperatures. Uncontrolled temperatures make reliable analysis impractical. Small changes in solvent composition or flow rate can alter the ion source temperature. For this reason what is needed is a more controlled manner for temperature control.

SUMMARY OF THE INVENTION

The present invention relates to an apparatus and method for sensor control and feedback. The apparatus may be used with a mass spectrometry system. The invention provides a source of ions, an infrared emitter adjacent to the source of ions for drying ions produced by the ion source, and a sensor disposed in the ion source and coupled to the infrared emitter by a closed feedback loop. The sensor is designed for sensing and heating ions to a defined temperature.

The method of the present invention comprises producing a source of ions, drying the ions, and using a sensor disposed in the ion source and coupled to an infrared emitter by closed feedback loop for sensing and heating ions to a defined temperature.

BRIEF DESCRIPTION OF THE FIGURES

The invention is described in detail below with reference to the following figures.

DETAILED DESCRIPTION OF THE INVENTION

Figure 1:
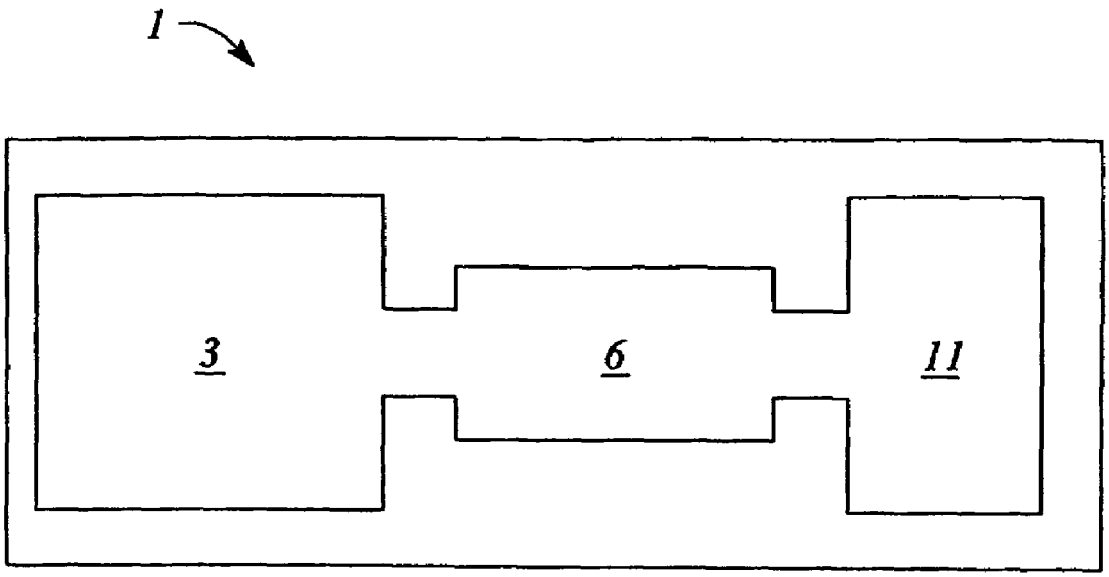
FIG. 1 shows general block diagram of a mass spectrometer.

Before describing the invention in detail, it must be noted that, as used in this specification and the appended claims, the singular forms "a," "an," and "the" include plural referents unless the context clearly dictates otherwise. Thus, for example, reference to "an infrared (IR) emitter" includes more than one "infrared (IR) emitter". Reference to a "matrix" includes more than one "matrix" or a mixture of "matrixes". In describing and claiming the present invention, the following terminology will be used in accordance with the definitions set out below.

The term "adjacent" means, near, next to or adjoining. Something adjacent may also be in contact with another component, surround the other component, be spaced from the other component or contain a portion of the other component. For instance, a conduit that is adjacent to a conduit may be spaced next to the conduit, may contact the conduit, may surround or be surrounded by the conduit, may contain the conduit or be contained by the conduit, may adjoin the conduit or may be near the conduit.

The term "conduit" or "collecting conduit" refers to any sleeve, transport device, dispenser, nozzle, hose, pipe, plate, pipette, port, connector, tube, coupling, container, housing, structure or apparatus that may be used to receive ions.

The term "ion source" or "source" refers to any source that produces analyte ions. Ion sources may include but not be limited to other sources besides EI, APPI, APCI, or AP-MALDI ion sources.

The term "ionization region" refers to the area between the ion source and the collecting conduit. In particular, the term refers to the analyte ions produced by the ion source that reside in that region and which have not yet been channeled into the collecting conduit. This term should be interpreted broadly to include ions in, on, about or around the target support as well as ions in the heated gas phase above and around the target support and collecting conduit. The ionization region in AP MALDI is around 1–5 mm in distance from the ion source (target substrate) to a collecting conduit (or a volume of 1–5 mm).

The term "ion transport system" refers to any device, apparatus, machine, component, conduit that shall aid in the transport, movement, or distribution of analyte ions from one position to another. The term is broad based to include ion optics, skimmers, capillaries, conducting elements and conduits.

The term "ion source" has broad based meaning to include one or more ionization devices.

The term "ionization device" refers to a particular device for producing ions. For instance an "ionization device" may comprise an APPI, APCI, CI, ESI, MALDI, AP-MALDI or other structure or method for producing a particular type of ion. The invention also has potential applications to GC mass spectrometry.

The terms "matrix based", or "matrix based ion source" refers to an ion source or mass spectrometer that does not require the use of a drying gas, curtain gas, or desolvation step. For instance, some systems require the use of such gases to remove solvent or cosolvent that is mixed with the analyte. These systems often use volatile liquids to help form smaller droplets. The above term applies to both nonvolatile liquids and solid materials in which the sample is dissolved. The term includes the use of a cosolvent. Cosolvents may be volatile or nonvolatile, but must not render the final matrix material capable of evaporating in vacuum. Such materials would include, and not be limited to m-nitrobenzyl alcohol (NBA), glycerol, triethanolamine (TEA), 2,4-dipentylphenol, 1,5-dithiothrietol/dierythritol (magic bullet), 2-nitrophenyl octyl ether (NPOE), thioglycerol, nicotinic acid, cinnamic acid, 2,5-dihydroxy benzoic acid (DHB), 3,5~dimethoxy-4-hydroxycinnamic acid (sinpinic acid), a-cyano-4-hydroxycinnamic acid (CCA), 3-methoxy-4-hydroxycinnamic acid (ferulic acid), monothioglycerol, carbowax, 2-(4-hydroxyphenylazo)benzoic acid (HABA), 3,4-dihydroxycinnamic acid (caffeic acid), 2-amino-4-methyl-5-nitropvridine with their cosolvents and derivatives. In particular the term refers to MALDI, AP-MALDI, fast atom/ion bombardment (FAB) and other similar systems that do not require a volatile solvent and may be operated above, at, and below atmospheric pressure.

The term "gas flow", "gas", or "directed gas" refers to any gas that is directed in a defined direction in a mass spectrometer. The term should be construed broadly to include monatomic, diatomic, triatomic and polyatomic molecules that can be passed or blown through a conduit. The term should also be construed broadly to include mixtures, impure mixtures, or contaminants. The term includes both inert and non-inert matter. Common gases used with the present invention could include and not be limited to ammonia, carbon dioxide, helium, fluorine, argon, xenon, nitrogen, air etc.

The term "gas source" refers to any apparatus, machine, conduit, or device that produces a desired gas or gas flow. Gas sources often produce regulated gas flow, but this is not required.

The term "detector" refers to any device, apparatus, machine, component, or system that can detect an ion. Detectors may or may not include hardware and software. In a mass spectrometer the common detector includes and/or is coupled to a mass analyzer. Typical detector examples include and are not limited to quadrupoles, triple quadrupoles, ion traps, time of flight (TOF), Q-TOF, ion mobility, ICP and ICR detectors. Other devices known in the art and not mentioned may also be employed.

The term "multimode" or "multimode ionization source" refers to an ion source that comprises more than one source for ionization. For instance, a multimode ionization source may comprise ESI with APPI, ESI with APCI, etc . . . Other combinations may be possible which have not been listed or described. Generally, speaking a multimode ionization source has the function of being able to capitalize on the use or implementation of multiple ion sources for improved ionization, or ionization of molecules that typically would not be ionizable by only one ion source.

A "plurality" is at least 2, e.g., 2, 3, 4, 6, 8, 10, 12 or greater than 12. The phrases "a plurality of" and "multiple" are used interchangeably. A plurality of conduits or gas streams contains at least a first conduit or gas stream and a second conduit or gas stream, respectively.

The invention is described with reference to the figures. The figures are not to scale, and in particular, certain dimensions may be exaggerated for clarity of presentation.

FIG. 1 shows a general block diagram of a mass spectrometry system. The block diagram is not to scale and is drawn in a general format because the present invention may be used with a variety of different types of mass spectrometers. A mass spectrometry system 1 of the present invention comprises an ion source 3, an ion transport system 6 and a detector 11. The ion source 3 may comprise one or more ionization devices and an IR emitter 8. For instance, the ion source 3 may comprise an ionization device 5 and/or ionization device 7. The IR emitter 8 may be adjacent to the ion source 3. It certain instances the IR emitter 8 is disposed in the ion source 3.

The ion source 3 may be located in a number of positions or locations. In addition, a variety of ion sources may be used with the present invention. For instance, ESI, APPI, APCI, AP-MALDI, MALDI or other ion sources well known in the art may be used with the invention. In other embodiments a multimode ion source may also be employed.

Figure 2:
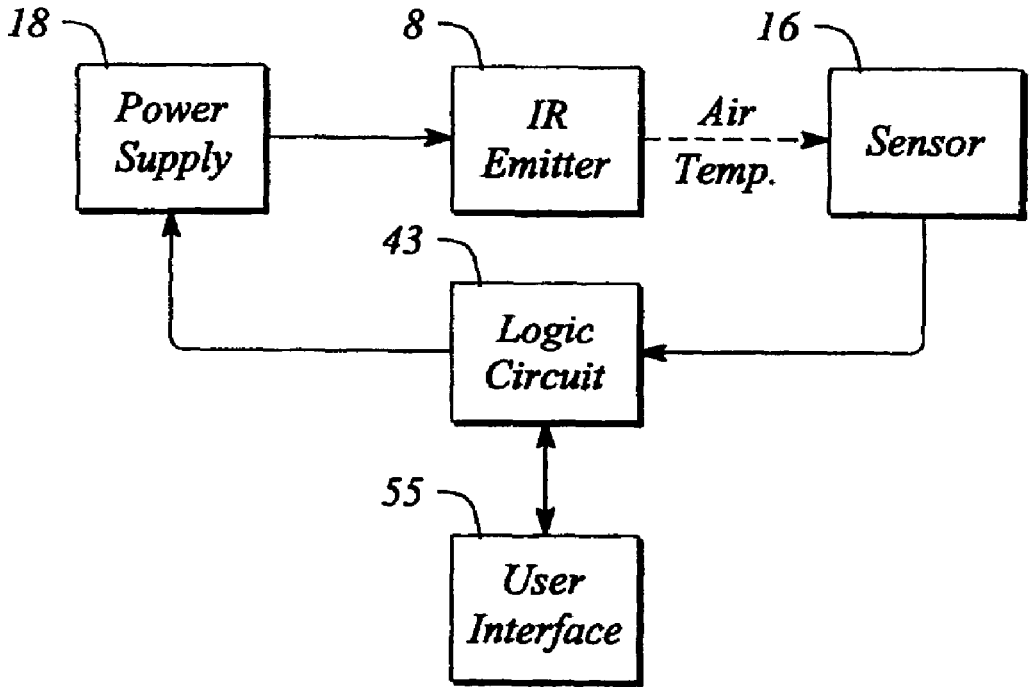
FIG. 2 shows a more detailed block diagram of a portion of the present invention.

FIG. 2 shows a block diagram of a portion of the present invention. The diagram shows a power supply 18 in connection with one or more IR emitters 8 and a sensor 16. A logic circuit 43 and optional user interface 55 may also be employed. The Sensor 16, power supply 18 and IR emitter 8 are in a closed feedback loop. Further discussion regarding the sensor 16, IR emitter 8 and closed feedback loop are provided below.

Figure 3:
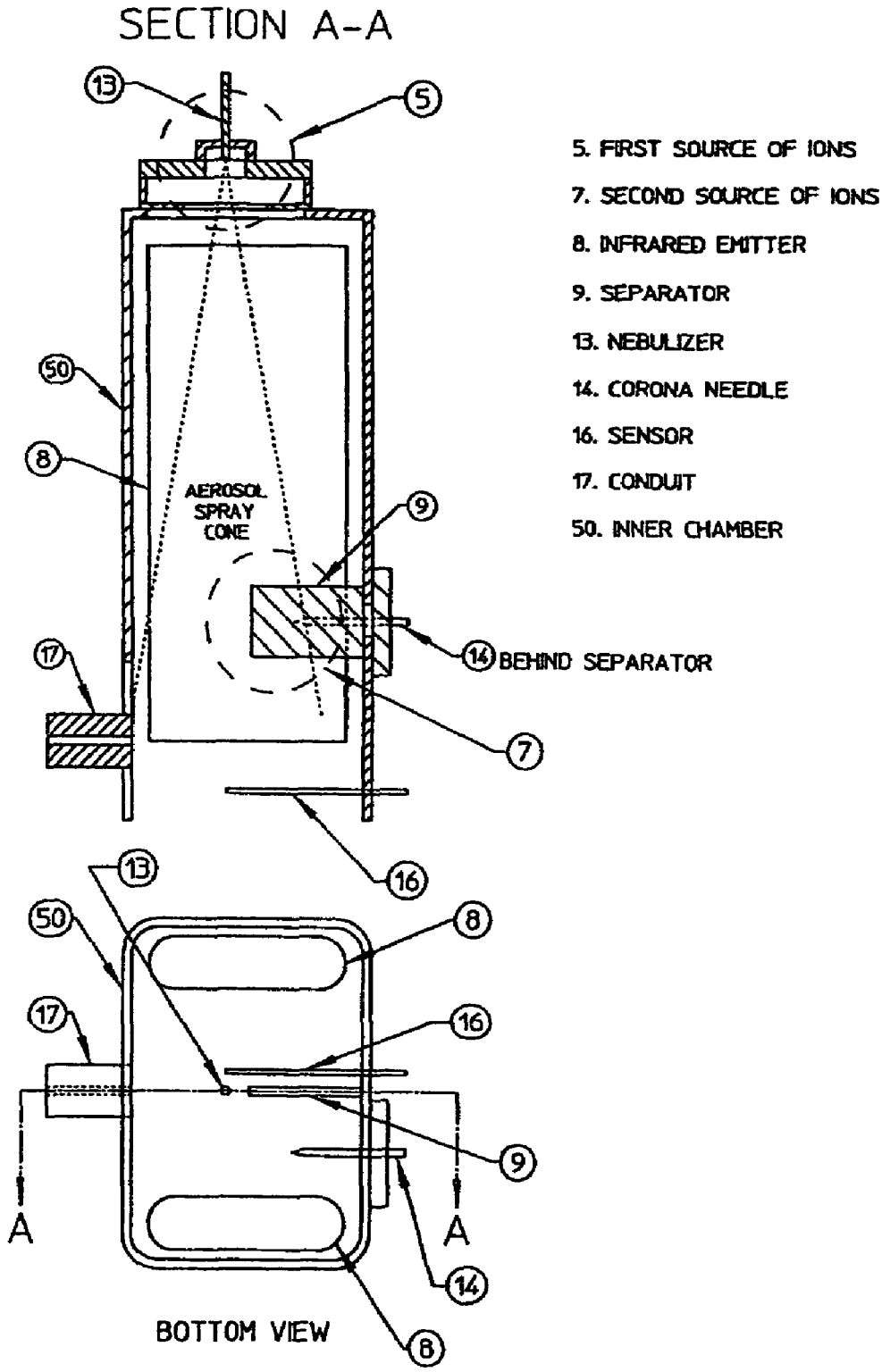
FIG. 3 shows a first embodiment of the present invention.
Figure 4:
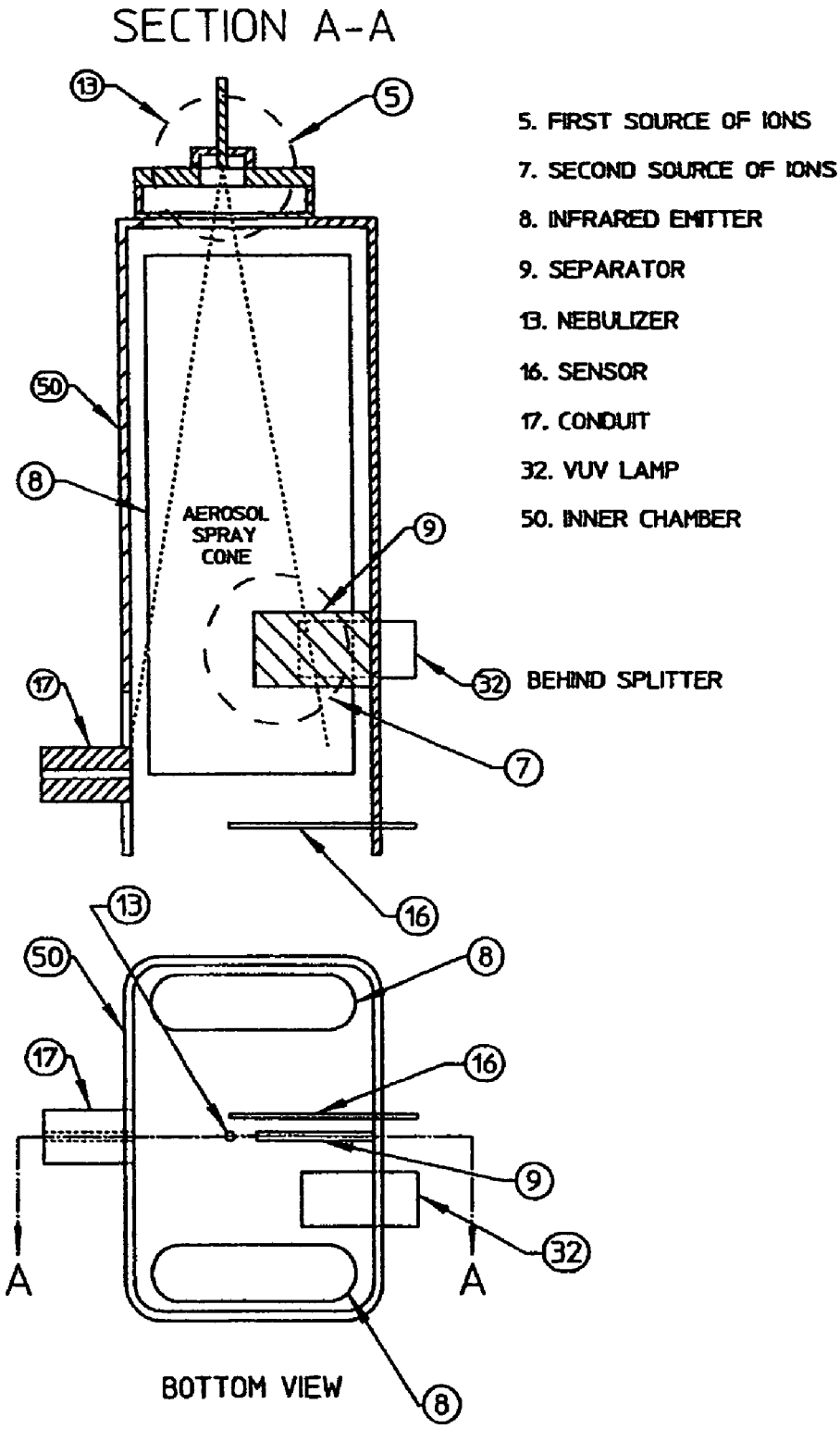
FIG. 4 shows a second embodiment of the present invention.

FIG. 3 shows a first embodiment of the invention. In this embodiment of the invention the ion source 3 comprises a multimode ionization source having an ESI and APCI ionization devices. Other combinations are possible to use with the present invention. FIG. 4 shows a similar type of device except that ESI is employed with APPI. Other combinations or methods for producing ions are possible. It should also be noted that for simplicity the present invention is described in light of the combination multimode ionization source. It can be imagined that the present invention may be employed with only ESI, CI, APPI, APPI, MALDI or AP-MALDI ionization sources or devices that are not multimode or that do not utilize multiple ionization sources. Other ion sources or ionization devices not discussed may also be employed with the present invention. From a functional standpoint it is important to the invention that the ion source, source of ions, or ionization device produce ions that require or utilize drying of the aerosol.

Referring to FIG. 3–4, the invention in its broadest sense may provide a multimode ionization source that incorporates multiple ionization devices into a single source. This may be accomplished by combining ESI functionality with one or more APCI and/or APPI functionalities. In the case of the multimode ionization source, analytes not ionized by the first ionization device or functionality should be ionized by the second ionization device or functionality.

The multimode ionization source 3 may comprise a first ionization device 5 and a second ionization device 7. The first ionization device 5 may be separated spatially or integrated with the second ionization device 7. The first ionization device 5 may also be in sequential alignment with the second ionization device 7. Sequential alignment, however, is not required. The term "sequential" or "sequential alignment" refers to the use of ionization devices in a consecutive arrangement. Ionization devices follow one after the other. This may or may not be in a linear arrangement. When the first ionization device 5 is in sequential alignment with the second ionization device 7, the ions must pass from the first ionization device 5 to the second ionization device 7. The second ionization device 7 may comprise all or a portion of the multimode ion source 3, all or a portion of the transport system 6, or all or a portion of both.

The first ionization device 5 may comprise an atmospheric pressure ion source and the second ionization device 7 may also comprise one or more atmospheric pressure ion sources. It is important to the invention that one or more of the ion sources provide a charged aerosol that needs to be dried.

FIG. 3 shows a first embodiment of the present invention in multimode design. The multimode ion source 3 comprises a first ionization device 5, a second ionization device 7 and conduit 17 all enclosed in a single source housing 10. The figures show the first ionization device 5 is closely coupled and integrated with the second ionization device 7. It is anticipated that the ionization devices may be placed in separate housings, locations or arrangements. In certain instances, the source housing 10 may not even be employed with the present invention. It should be mentioned that although the source is normally operated at atmospheric pressure (around 760 Torr) it can be maintained alternatively at pressures from about 20 to about 2000 Torr.

The ion source 3 of the present invention comprises a nebulizer 13, an IR emitter 8, a corona needle 15, and sensor 16 with closed feedback loop. The closed feedback loop may comprise an optional user interface 55 (See FIG. 2.). The feedback loop connects the IR emitter 8 to the sensor 16 and may be employed for adjusting the amount of power supplied to the IR emitter 8 by the power supply 18. The power may be supplied by any number of power supplies known in the art. It should be noted that each of the components of the nebulizer 13 may be separate or integrated with the source housing 10.

An IR emitter 8 is employed to provide the drying to the aerosol. The IR emitter 8 is connected to the sensor 16 with closed feedback loop. The power supply 18 may be any number of power supplies well known in the art. In addition, any number of power supplies may be employed. For instance, separate power supplies may be used with each ionization device. These differing power supplies may be used for turning "off" and "on" the varying ionization devices (APPI, APCI, ESI, etc . . . ).

It is important to establish an electric field at the nebulizer tip to charge the ESI liquid. The nebulizer tip must be small enough to generate the high field strength. The nebulizer tip will typically be 100 to 300 microns in diameter. In the case that the second ionization device 7 is an APCI ion source, a corona needle 14 may be employed. A corona discharge is produced by a high electric field at the corona needle 14, the electric field being produced predominantly by the potential difference between the corona needle 14 and conduit 17.

The sensor 16 and closed feedback loop to the IR emitter 8 are important to the invention. In particular, the sensor 16 may comprise any number of sensors well known in the industry. For instance, the sensor may be a thermal sensor. The sensor may also be selected from the group consisting of a thermocouple, a thermistor, a thermopile, a semiconductor or semiconductor material, a chip, or other detection device well known in the art. Typically, the application of a sensor 16 with closed feedback loop to the IR emitter 8 provides control of the temperature within the ion source 3. Other hardware and software known in the art may be employed with the present invention or be employed as an interface. In addition, by being able to control the environment in the ion source less nitrogen gas may be employed. For instance, a typical electrospray source would require around 15 Liters/min. in nitrogen gas. Using an IR emitter 8 coupled to a sensor and feedback loop can lower the nitrogen gas requirements to around 7 Liters/min.

FIG. 4 shows a second embodiment of the present invention. In this embodiment of the invention a multimode ion source is shown. Except in this case, the second ionization device 7 is an APPI source. In this ion source an ultraviolet light 32 or similar type lamp is employed with the present invention. Typically, the ultraviolet lamp 32 is interposed between the first ionization device 5 and the conduit 17. The ultraviolet lamp 32 may comprise any number of lamps that are well known in the art and are capable of ionizing molecules. The second ionization device 7 may be positioned in a number of locations downstream from the first ionization device 5 and the broad scope of invention should not be interpreted as being limited or focused to the embodiments shown and discussed in the figures. The other components and application of the sensor with feedback loop and IR emitter 8 are the same as employed and implemented in the other embodiments described above. For clarification please refer to the above-mentioned description.

The ion source 3 has an inner chamber 50. The inner chamber 50 comprises an enclosure for an IR emitter 8 and may be of any convenient shape, size and material suitable for sufficiently drying the aerosol it receives and confining the heat generated by the infrared emitter 8 within the enclosed space. Suitable materials may comprise stainless steel, molybdenum, titanium, silicon carbide or other alloys or high temperature materials. The IR emitter 8 is coupled to the inner chamber 50 and may comprise one or more IR lamps that generate infrared radiation when electrically excited. The infrared lamps may be of various configurations and may also be positioned within the inner chamber 50 in various ways to maximize the amount of heat applied to the aerosol. For example, the infrared emitter may be configured using "flat" lamps placed on opposite sides or ends of the inner chamber 50 and extending longitudinally along its length to achieve an even distribution of radiation through the longitudinal length of the chamber. An example of a typical type IR lamp would be a shortwave lamp such as the Heraeus Noblelight GMbH which is displayed on the Heraeus website Http://www.noblelight.net. Alternatively, the infrared emitter 8 may be configured concentrically to surround a portion of the aerosol as it flow through the inner chamber 50 to promote radially symmetric irradiation of the aerosol.

It is useful for the infrared emitter 8 to emit peak radiation intensity in a wavelength range that matches the absorption band of the solvent used in the aerosol. For many solvents, this absorption band lies between 2 and 6 microns. To emit IR radiation as such wavelengths, the lamps may be operated at temperatures at or near 900 degrees Celsius. For example, the radiation absorption band of water (approximately 2.6 to 3.9 microns) has a peak in the range of 2.7 microns, so that when water is the solvent, it is advantageous to irradiate at or near the wavelength to maximize heating efficiency. Other solvents, such as alcohols and other organic solvents, may have absorption peaks at longer wavelengths, and thus it is more efficient, when using such solvents, to tune the peak IR emission to longer wavelengths. It is to be understood, however, that a portion of the radiation emitted by the IR emitter normally lies outside of the "peak" band and encompasses both shorter and longer wavelengths.

The intensity of the IR emission lamps is controlled by a sensor 16 with closed feedback loop coupled to the IR emitter 8. It is important to maintain the temperature within the inner chamber 50 in a suitable range for desolvating the solvent molecules from the analyte ions. In certain cases, it may be ideal to change these parameters depending upon the analyte and point in processes. For these reasons the closed feedback loop between IR emitter 8 and sensor 16 is ideal. When the solvent is water, the temperature within the inner chamber is typically maintained in a range of about 120 to 160 degrees Celsius.

Figure 5:
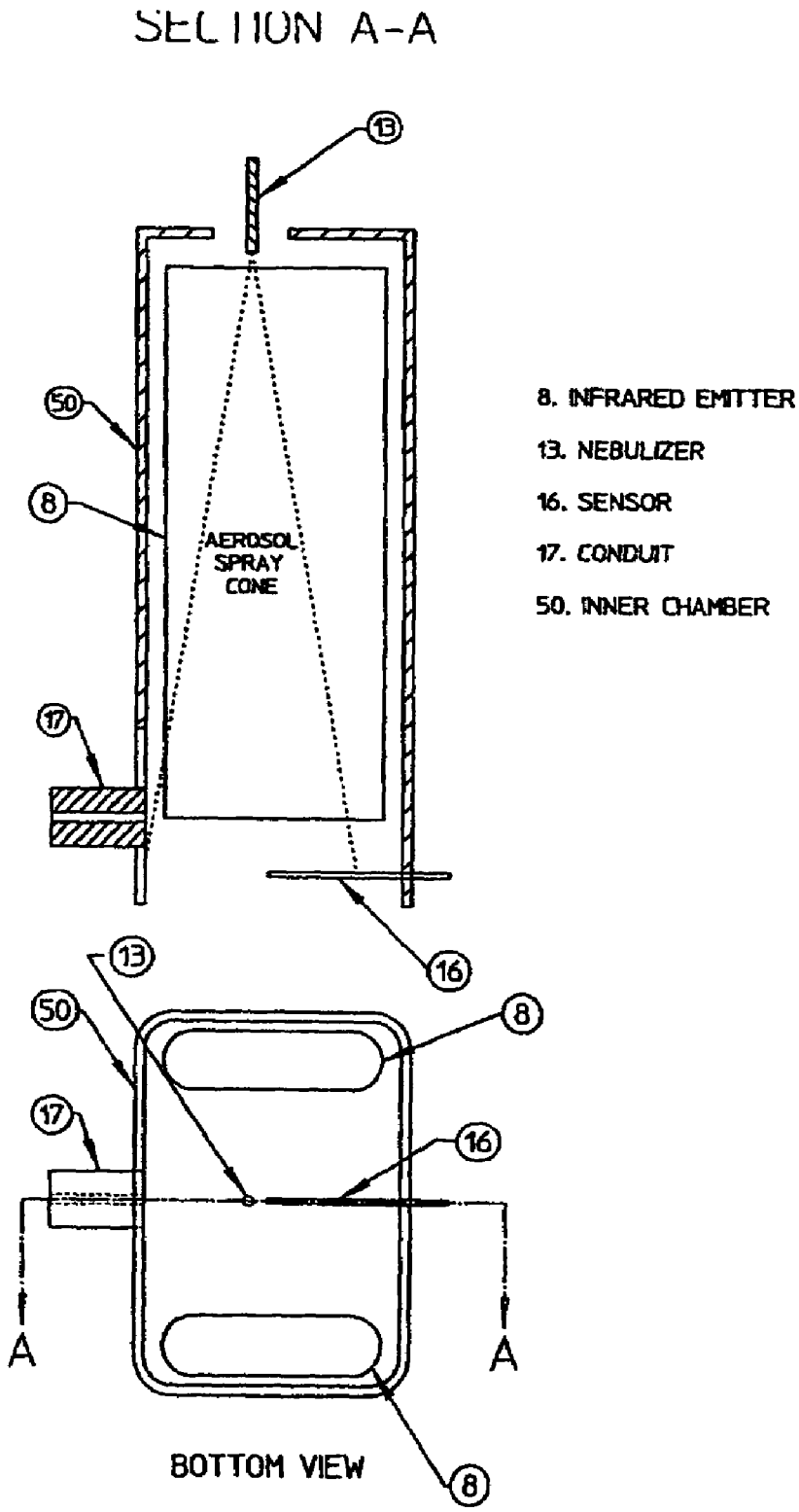
FIG. 5 shows a third embodiment of the present invention.
Figure 6:
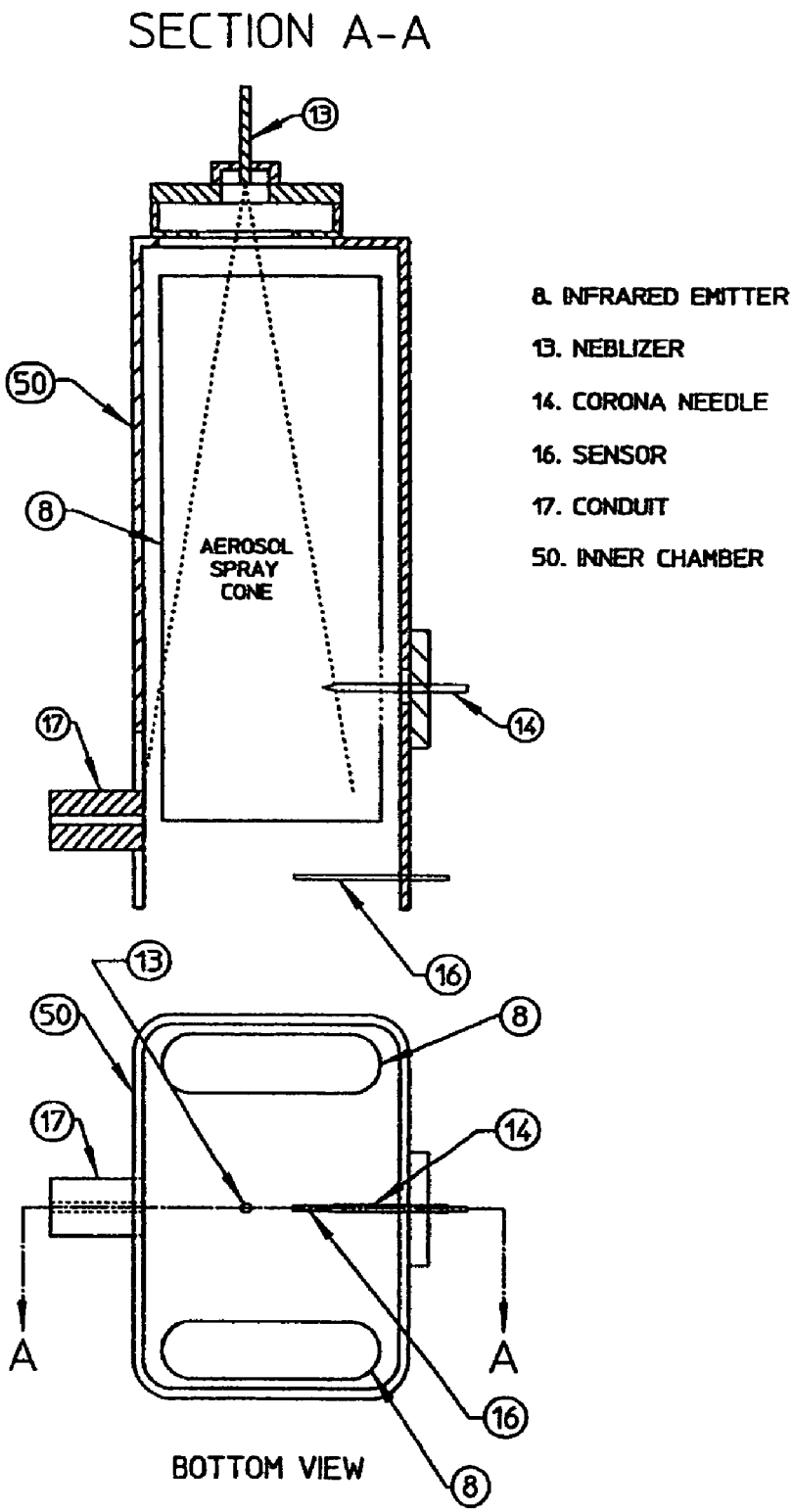
FIG. 6 shows a fourth embodiment of the present invention.
Figure 7:
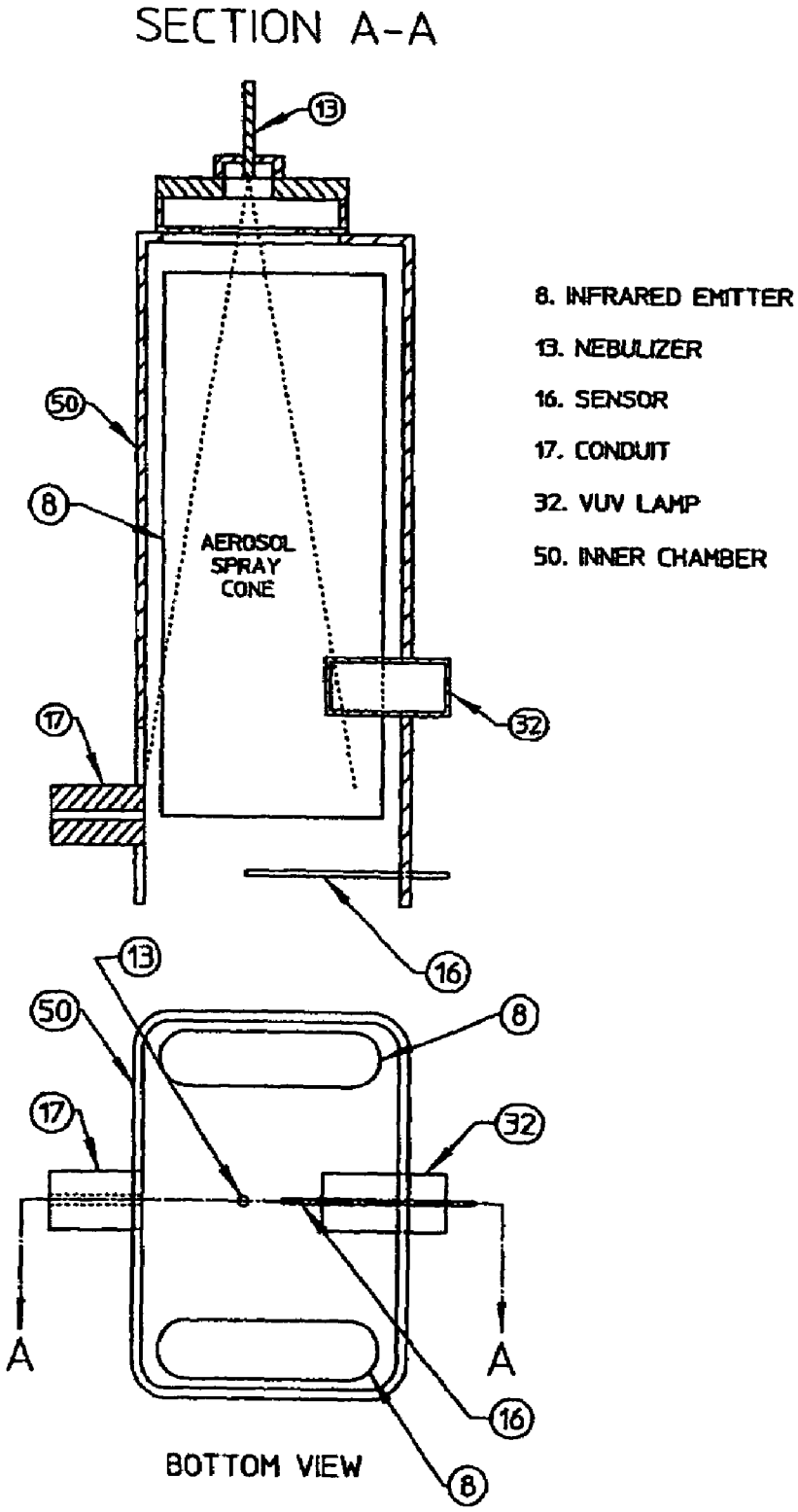
FIG. 7 shows a fifth embodiment of the present invention.

FIGS. 5–7 show similar embodiments to the multimode design as described above. Except in each case single ionization devices are employed. The important point being that the present invention is not limited to multimode design, but also has application to individual ionization devices.

Figure 8:
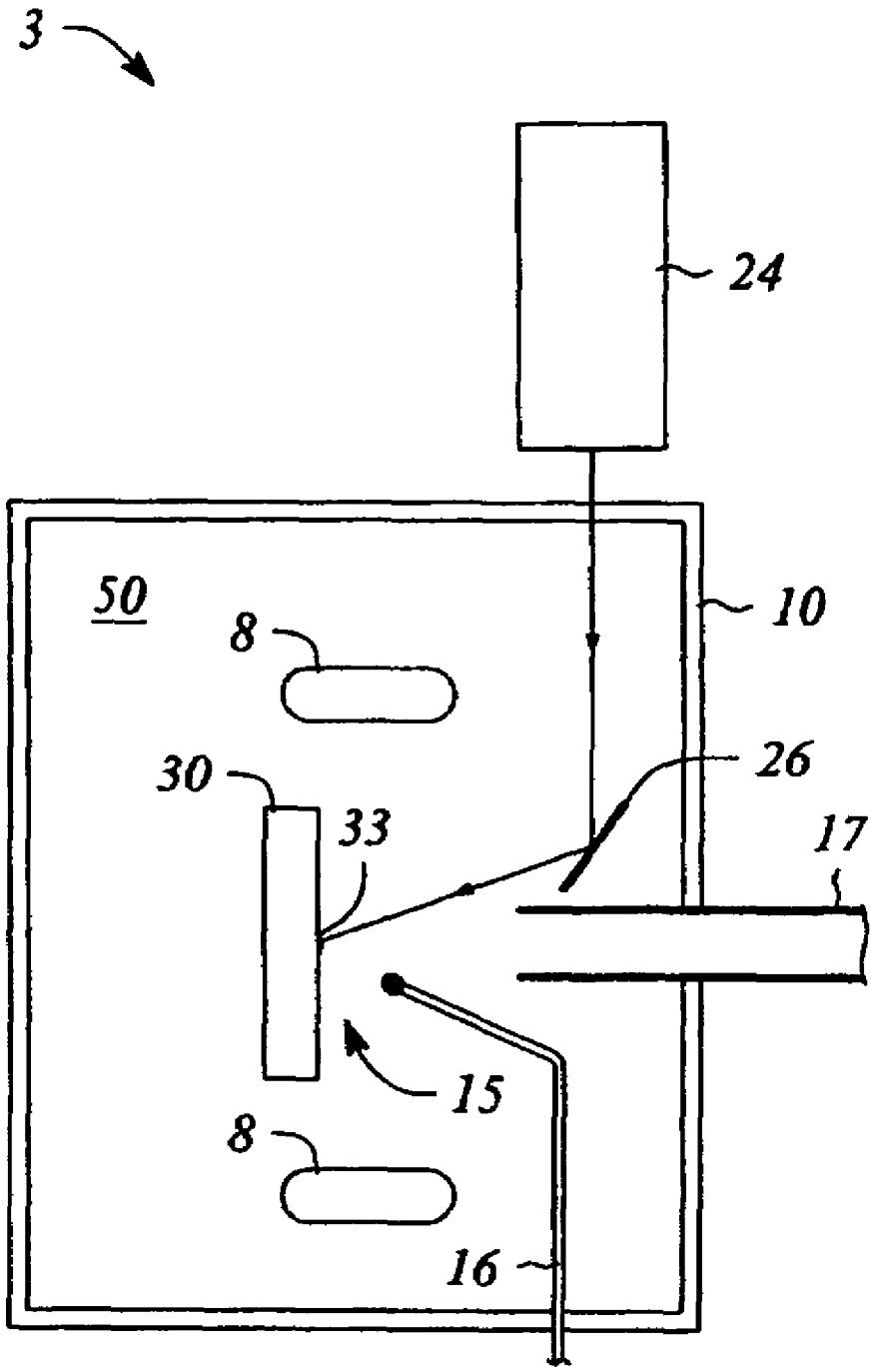
FIG. 8 shows a sixth embodiment of the present invention.

FIG. 8 shows another embodiment of the present invention. In this embodiment, the invention is applied to a MALDI or AP-MALDI device.

The ion source 3 comprises a laser 24, a deflector 28 and a target support 30. A target 33 is applied to the target support 30 in a matrix material well known in the art. The laser 24 provides a laser beam that is deflected by the deflector 28 toward the target 33. The target 33 is then ionized and the analyte ions are released as an ion plume into an ionization region 15.

The ionization region 15 is located between the ion source 3 and the collecting conduit 19. The ionization region 15 comprises the space and area located in the area between the ion source 3 and the collecting conduit 19. This region contains the ions produced by ionizing the sample that are vaporized into a gas phase. This region can be adjusted in size and shape depending upon how the ion source 3 is arranged relative to the collecting conduit 19. Most importantly, located in this region are the analyte ions produced by ionization of the target 33.

The collecting conduit 19 is located downstream from the ion source 3 and may comprise a variety of material and designs that are well known in the art. The collecting conduit 19 is designed to receive and collect analyte ions produced from the ion source 3 that are discharged as an ion plume into the ionization region 15.

The detector 11 is located downstream form the second ionization device 7. The detector 11 may comprise a mass analyzer or other similar device well known in the art for detecting and enhancing analyte ions that were collected and transported by the transport system 6. The detector 11 may also comprise any computer hardware and software that are well known in the art and which may help in detecting analyte ions.

Having described the apparatus of the invention and components in some detail it is also necessary to describe the method of the present invention. A method of producing ions using the present invention comprises producing a charged aerosol by a first atmospheric pressure ionization source, drying the charged aerosol using an IR emitter and applying a sensor to detect the temperature and conditions in the ion source 3 to optimize ionization. As with the multimode ionization source, it is within the scope of the invention that one or more sources may be turned "on" or "off" when using the present invention and/or method.

The method of the invention begins with the production of a source of ions 2. The source of ions 2 may be produced by any of the known ion sources known in the art. For illustration purposes the multimode ionization source with ESI/APCI ion source capabilities will be described. The ions travel down the nebulizer conduit to the nebulizer tip where they are ejected into inner chamber 50. The ions are then subject to drying by the IR emitter(s) 8. As mentioned before, the IR emitter(s) 8 are positioned on either side of the inner chamber 50. The IR emitter(s) 8 has the advantage of drying the ions in a more controlled fashion. The heat can be controlled and the drying applied methodically to the ions passing down the inner chamber 50. After the ions have been dried they are then subject to further ionization either by a corona needle of an APCI source or a UV lamp used in an APPI source. Other secondary ionization techniques may be employed. As mentioned earlier the present invention may also be employed with a single ion source. After further ionization takes place, the ions then contact the sensor 16. The sensor 16 is then used to regulate the heat that is provided to the ion stream upstream. This is done through a closed feedback loop that connects the sensor 16 to the IR emitter 8. Ideally, the feedback loop and sensors can regulate desired power and heat to the IR emitters 8 to maximize the ionization of analyte flowing through the inner chamber 50.

In the case of MALDI and AP-MALDI the process is very similar. However, in this case a laser 24 is employed to ionize the target 33 from the target support 28. The sensor 16 is positioned adjacent to the IR emitters 8 and the ionization region 15 and again provides feedback to the IR emitters for heating the ions in the ionization region 15. It should be noted that the application of heat by the IR emitters 8 to the ions is slightly different with MALDI and AP-MALDI. In these applications a certain amount of ion cooling takes place between when the ions are formed and then collected by the conduit 19. In addition, there is a certain amount of clustering that takes place that interferes with the overall formation of ions. The use of a sensor 16 with closed feedback loop allows for the optimization of this process so that more ions are formed and clustering can be avoided.

It is to be understood that while the invention has been described in conjunction with the specific embodiments thereof, that the foregoing description as well as the examples that follow are intended to illustrate and not limit the scope of the invention. Other aspects, advantages and modifications within the scope of the invention will be apparent to those skilled in the art to which the invention pertains.

All patents, patent applications, and publications infra and supra mentioned herein are hereby incorporated by reference in their entireties.

We claim:

1. An ion source for a mass spectrometry system comprising:

(a) an ionization device for producing ions;

(b) an infrared emitter adjacent to the ionization device for drying ions produced by the ionization device, the infrared emitter receiving energy from a power supply, and emitting IR radiation having an intensity controllable via the power supply;

(c) a sensor adjacent to the infrared emitter adapted to produce a signal indicative of a temperature of the ions; and (d) a logic circuit for receiving the signal from the sensor and adapted to provide a feedback signal to the power supply to maintain a selected temperature range.

2. The ion source of claim 1, wherein the ionization device includes an electrospray (ESI) device.

3. The ion source of claim 2, wherein the ionization device further includes a second ionization device comprising one of a corona needle and a VUV photon source.

4. The ion source of claim 3, wherein the temperature sensor is disposed downstream from the second ionization device.

5. The ion source of claim 1, wherein the ionization device includes a corona needle.

6. The ion source of claim 1, wherein the ionization device includes a VUV photon source.

7. A method of optimizing ion collection in an ion source of a mass spectrometry system comprising:

producing ions in the ion source;

drying the ions using an IR emitter that radiates infrared energy of a controllable intensity;

detecting a temperature of the ions downstream from the IR emitter; and controlling the intensity of the infrared energy based on the detected temperature so as to optimize collection of the ions.

8. The method of claim 7, wherein the controlling comprises adjusting an amount of power provided to the IR emitter.

9. The method of claim 8, wherein the controlling is performed using a logic circuit.

10. The method of claim 7, wherein the ions are produced at atmospheric pressure.

11. The method of claim 7, wherein the detecting is performed by a sensor selected from the group of: a thermocouple, a thermistor, a thermopile, and a semiconductor device.

* * * * *